US009480345B2

(12) United States Patent
Lee et al.

(10) Patent No.: US 9,480,345 B2
(45) Date of Patent: Nov. 1, 2016

(54) SHOWCASE INCLUDING TRANSPARENT DISPLAY PANEL, AND SHOWCASE SYSTEM INCLUDING SAME

(71) Applicant: LG ELECTRONICS INC., Seoul (KR)

(72) Inventors: Ki Young Lee, Seoul (KR); Sung Wook Han, Seoul (KR); Jun Kim, Seoul (KR); Young Jun Lee, Seoul (KR); Jae Min Han, Seoul (KR); Joon Young Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 146 days.

(21) Appl. No.: 14/357,162

(22) PCT Filed: Nov. 8, 2012

(86) PCT No.: PCT/KR2012/009381

§ 371 (c)(1),
(2) Date: May 8, 2014

(87) PCT Pub. No.: WO2013/069977

PCT Pub. Date: May 16, 2013

(65) Prior Publication Data

US 2015/0002747 A1 Jan. 1, 2015

(30) Foreign Application Priority Data

Nov. 9, 2011 (KR) ..... 10-2011-0116382

(51) Int. Cl.
*A47F 11/10* (2006.01)
*A47F 3/00* (2006.01)
(Continued)

(52) U.S. Cl.
CPC ..... *A47F 3/001* (2013.01); *A47F 11/06* (2013.01); *A47F 11/10* (2013.01); *G09G 3/36* (2013.01); *A47F 3/005* (2013.01); *G09G 2370/025* (2013.01)

(58) Field of Classification Search
CPC ..... G09G 3/36; A47F 3/005; A47F 3/001
See application file for complete search history.

(56) References Cited

U.S. PATENT DOCUMENTS 4,456,335 A * 6/1984 Mumford ..... E06B 3/6722 349/16
6,735,022 B1 * 5/2004 Solitt ..... A47F 7/02 206/566

(Continued)

FOREIGN PATENT DOCUMENTS

CN 101238938 A 8/2008
JP 8-126557 A 5/1996

(Continued)

OTHER PUBLICATIONS

English Translation of JP 2004294705.*

*Primary Examiner* — Evan Dzierzynski
(74) *Attorney, Agent, or Firm* — Birch, Stewart, Kolasch & Birch, LLP

(57) ABSTRACT

A showcase including a plurality of frames including a front frame and an upper frame defining a showroom; a transparent display panel placed at the front frame among the frames, the transparent display panel displaying an image; and a light source unit configured to emit light into the showroom, wherein the light source unit is located between an opaque upper portion of the front frame surrounding the transparent display panel and the upper frame, and wherein the light source unit includes a plurality of lamps at each corner of the showcase and is obliquely arranged in a direction from the front frame to the upper frame, and positions of the plurality of lamps are increased in height with an increasing distance from the front frame to the upper frame.

17 Claims, 14 Drawing Sheets

(51) Int. Cl.
*G09G 3/36* (2006.01)
*A47F 11/06* (2006.01)

(56) References Cited

U.S. PATENT DOCUMENTS

2008/0212314 A1* 9/2008 Swofford ..... A47F 3/001 362/126
2008/0247154 A1* 10/2008 Lim ..... F25D 27/00 362/92
2010/0309237 A1* 12/2010 Roh ..... G06F 3/1431 345/691
2011/0102750 A1 5/2011 Ikeda et al.
2011/0181792 A1 7/2011 Hammonds
2011/0216250 A1* 9/2011 Sim ..... F21V 7/22 348/801

FOREIGN PATENT DOCUMENTS

JP 2000-308551 A 11/2000
JP 2004-294705 A 10/2004
JP 2005-299964 A 10/2005

* cited by examiner

SHOWCASE INCLUDING TRANSPARENT DISPLAY PANEL, AND SHOWCASE SYSTEM INCLUDING SAME

FIELD OF THE INVENTION

The present invention relates to a showcase including a transparent display panel and more particularly to a showcase including a transparent display panel which may reduce shadowing of a product placed in the showcase.

DESCRIPTION OF THE BACKGROUND ART

A showcase includes a showroom in which products can be exhibited. Typically, the front face of a showcase is formed of glass. Users can view products placed in the showroom through the front glass of the showcase.

SUMMARY OF THE INVENTION

It is an object of the present invention to provide a showcase including a transparent display panel, which may reduce shadowing of a product placed in the showcase.

In accordance with one embodiment of the present invention, the above and other objects can be accomplished by the provision of a showcase including frames defining a showroom, a transparent display panel placed at a front frame among the frames, the transparent display panel displaying an image, and a light source unit configured to emit light into the showroom, the light source unit being obliquely arranged in a direction from the front frame to an upper frame among the frames.

In accordance with another embodiment of the present invention, there is provided a showcase system including a signal processing device configured to output a video signal, and a showcase including frames defining a showroom, a transparent display panel placed at a front frame among the frames, the transparent display panel displaying an image corresponding to the video signal, and a light source unit configured to emit light into the showroom, the light source unit being obliquely arranged in a direction from the front frame to an upper frame among the frames.

According to an embodiment of the present invention, as a transparent liquid crystal panel is installed to a front face of a showcase to display an image related to a product, improved product advertisement effects may be accomplished via exhibition of a product placed in a showroom as well as display of an image related to the product.

Meanwhile, according to an embodiment of the present invention, as a light source unit is obliquely arranged between a front frame and an upper frame of the showcase, it is possible to reduce shadowing of the product placed in the showroom due to light emitted from the light source unit.

Meanwhile, as a bottom surface of the showcase defining the showroom has a downhill structure, a person may perceive three-dimensional effects with respect to the showroom, and consequently may stereoscopically view the product in the showroom.

Meanwhile, when the showroom in the showcase has an oval rear face convexly protruding toward a rear frame, there occurs no edge at seams of inner wall surfaces of the showcase, which may reduce likelihood of shadowing at the corresponding edge region.

Meanwhile, as a display stand is tilted from the rear frame to a lower frame in the showroom of the showcase, light may be uniformly emitted to all products located at upper and lower positions of the display stand.

With regard to multiple shelves attached to the display stand, a shelf located lower than others has a longer length. This ensures that light reaches a product on the lower shelf without being blocked by an upper shelf or a product on the upper shelf.

Meanwhile, the multiple shelves of the display stand are detachably attached, which ensures simplified change in the arrangement of products in the showroom of the showcase.

Meanwhile, as a front frame takes the form of a front door that can be opened and closed, a user may simply change the arrangement of products in the showroom.

Meanwhile, assuming provision of a plurality of doorframes, a first doorframe in which a timing controller board is installed has a greater size than that of a doorframe facing thereto, which ensures stable installation of the timing controller board.

DETAILED DESCRIPTION OF THE EMBODIMENTS OF THE INVENTION

Hereinafter, the present invention will be described in more detail with reference to the accompanying drawings.

With respect to constituent elements used in the following description, suffixes "module" and "unit" are given or mingled with each other only in consideration of ease in the preparation of the specification, and do not have or serve as different meanings.

Figure 1:
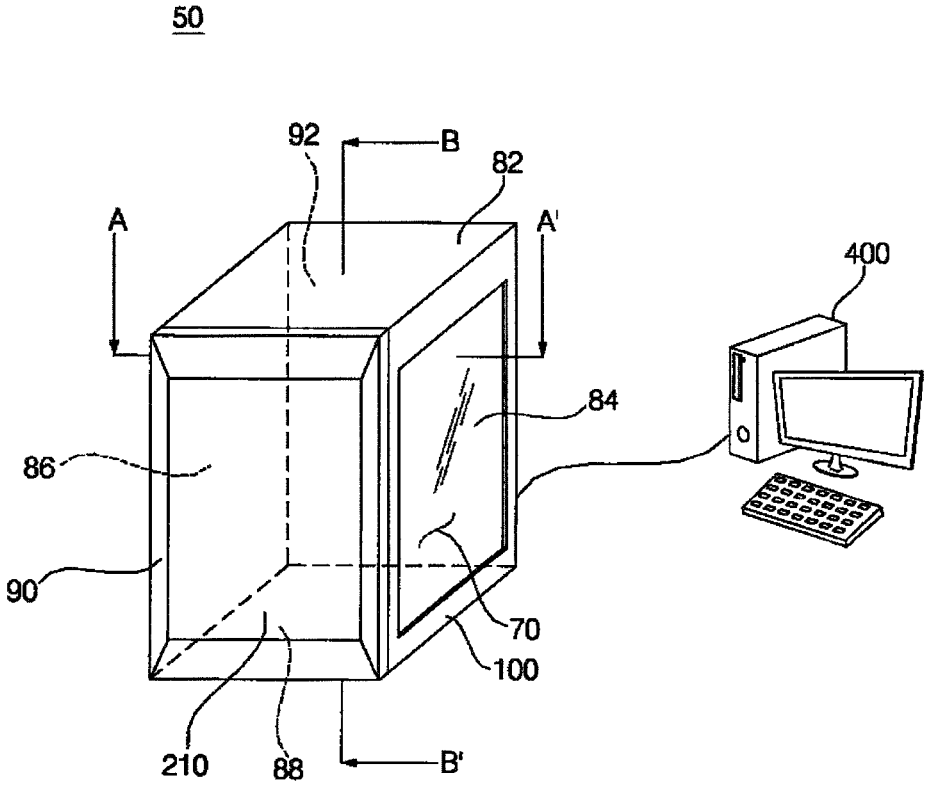
FIG. 1 is a view showing a configuration of a showcase system according to one embodiment of the present invention.

FIG. 1 is a view showing a configuration of a showcase system according to one embodiment of the present invention.

Referring to FIG. 1, the showcase system 50 according to the embodiment of the present invention may include a showcase 100 having a transparent display panel and a signal processing device 400 configured to output, e.g., a video signal or an audio signal to the showcase 100.

The showcase 100 according to the embodiment of the present invention may have a volumetric shape to internally define a showroom 70 in which a product can be placed. The drawing shows a hexahedral showcase 100.

To this end, the showcase 100 may include a transparent display panel, for example, a liquid crystal panel 210 provided at a front face thereof and a front frame 90 surrounding the liquid crystal panel 210.

In the embodiment of the present invention, as the transparent liquid crystal panel 210 is installed to the front face of the showcase 100 and an image related to a product is displayed on the liquid crystal panel 210. As such, through exhibition of the product in the showroom 70 and display of the image related to the product, improved product advertisement effects may be achieved.

In addition, the showcase 100 includes a right frame 84 provided at a right face thereof, a left frame 86 provided at a left face thereof, an upper frame 82 provided at an upper face thereof, a lower frame 88 provided at a lower face thereof, and a rear frame 92 provided at a rear face thereof.

In this case, a transparent glass may be surrounded by the right frame 84. In addition, a transparent glass may be surrounded by the left frame 86. With this configuration, a person can view the product placed in the showroom 70 through the left face and the right face of the showcase as well as the front face of the showcase, which may improve advertisement effects.

Alternatively, instead of the transparent glass fitted into the right frame 84, a transparent liquid crystal panel may be provided. Likewise, instead of the transparent glass fitted into the left frame 86, a transparent liquid crystal panel may be provided. Accordingly, since a person can view the product placed in the showroom 70 in any direction among front, right and left directions and the user can view the image related to the product via the liquid crystal panel, improved product advertisement effects may be achieved.

Meanwhile, although not shown in the drawing, a light source unit 175 may be located in the showcase 100, more particularly, in an upper region of the showcase. In the embodiment of the present invention, as the light source unit 175 is located between the front frame 90 and the upper frame 82 and, in particular, the light source unit 175 is obliquely arranged, it is possible to reduce shadowing of a product placed near the center of the showroom 70 due to light emitted from the light source unit 175. This will be described below with reference to FIG. 5.

Meanwhile, although not shown in the drawing, the showcase 100 may include a signal processing unit which receives a signal processed by the signal processing device 400 and processes the received signal. This will be described below with reference to FIG. 12.

The signal processing device 400 may process a video or audio signal stored in the signal processing device 400 to provide the showcase 100 with the processed signal, or may process a video or audio signal input via an external network to provide the showcase 100 with the processed signal. For example, the signal processing device 400 may be a personal computer (PC).

Alternatively, differently from the drawing, the signal processing device 400 may be incorporated in the showcase 100.

Figure 2:
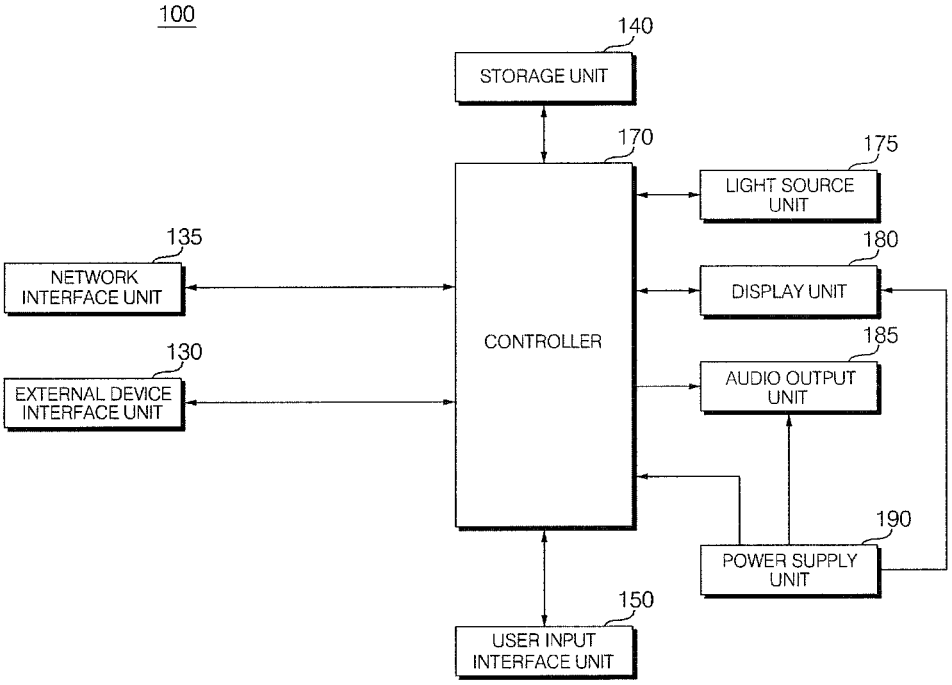
FIG. 2 is a block diagram showing one example of an inner configuration for signal processing in a showcase.

FIG. 2 is a block diagram showing one example of an inner configuration for signal processing in a showcase.

First, referring to FIG. 2, the showcase 100 according to one embodiment of the present invention may include an external device interface unit 130, a network interface unit 135, a storage unit 140, a user input interface unit 150, a controller 170, the light source unit 175, a display unit 180, an audio output unit 185, and a power supply unit 190.

The external device interface unit 130 may provide an interface to interconnect an external device and the showcase 100 in a wired or wireless manner. For example, the external device interface unit may receive at least one of a processed video signal and a processed audio signals input from the signal processing device 400. In addition, the external device interface unit may transmit data to the signal processing device 400.

The network interface unit 135 provides an interface to interconnect the showcase 100 and a wired/wireless network including the Internet. For example, the network interface unit 135 may receive content or data provided by an Internet or content provider or a network manager via a network.

The storage unit 140 may store programs for signal processing and control in the controller 170, and may store processed image, voice or data signals.

In addition, the storage unit 140 may function to temporarily store video, audio, or data signals to be input to the external device interface unit 130.

Although the embodiment of FIG. 2 illustrates that the storage unit 140 is provided separately from the controller 170, the scope of the present invention is not limited thereto. The storage unit 140 may be included in the controller 170.

The user input interface unit 150 may transmit a signal input by the user to the controller 170, or may transmit a signal from the controller 170 to the user.

For example, in a case in which a touch panel is disposed on the liquid crystal panel 210, the user input interface unit may receive a user touch input signal to transmit the user touch input signal to the controller 170, may transmit a user input signal input from a sensing unit (not shown) that senses a gesture of the user to the controller 170, or may transmit a signal from the controller 170 to the sensing unit (not shown).

The controller 170 may generate and output a signal for output of an image or voice by demultiplexing a stream input via the external device interface unit 130 or by processing demultiplexed signals.

An image signal processed in the controller 170 may be input to the display unit 180 such that an image corresponding to the image signal is displayed on the display unit. In addition, the image signal processed in the controller 170 may be input to an external output device via the external device interface unit 130.

An audio signal processed in the controller 170 may be output as sound via the audio output unit 185.

Although not shown in FIG. 2, the controller 170 may include a demultiplexer, an image processor and the like. This will be described below with reference to FIG. 4.

In addition, the controller 170 may control general operations of inner components of the showcase 100.

In addition, the controller 170 may control the showcase 100 in response to a user instruction input via the user input interface unit 150, or using inner programs thereof.

Meanwhile, the controller 170 may control the display unit 180 to display an image. In this case, the image displayed on the display unit 180 may be a still image or a moving image and may be a 2D image or a 3D image.

The display unit 180 generates a drive signal by converting an image signal, a data signal, an OSD signal and a control signal processed in the controller 170, or by converting an image signal, a data signal, a control signal and the like received from the external device interface unit 130.

The display unit 180, according to the embodiment of the present invention, may include a transparent display panel. For example, the display unit may include a liquid crystal panel. In this case, the liquid crystal panel does not include a backlight.

The audio output unit 185 outputs voice upon receiving an audio signal processed in the controller 170.

Meanwhile, to sense a gesture of the user, as described above, the showcase 100 may further include the sensing unit (not shown) which includes at least one of a touch sensor, a voice sensor, a position sensor and a motion sensor. A signal sensed by the sensing unit (not shown) is transmitted to the controller 170 via the user input interface unit 150.

The controller 170 may sense a gesture of the user based on an image captured by an image capture unit (not shown), a signal sensed by the sensing unit (not shown), or combinations thereof.

The power supply unit 190 supplies corresponding power to the entire showcase 100. In particular, the power supply unit may supply power to the controller 170 that may take the form of a System On Chip (SOC), the display unit 180 for display of an image, and the audio output unit 185 for audio output.

To this end, the power supply unit 190 may include a converter (not shown) to convert Alternating Current (AC) power into Direct Current (DC) power. In addition, the power supply unit may further include a DC/DC converter that changes the level of DC power and outputs the DC power having the changed level.

Meanwhile, although not shown in the drawing, the showcase 100 may further include a broadcast receiver (not shown). For example, the broadcast receiver may include a tuner (not shown) and a demodulator (not shown) for broadcast reception and signal processing.

Meanwhile, the block diagram of the showcase 100 shown in FIG. 2 shows one embodiment of the present invention. Respective components of the block diagram may be integrated, added, or omitted according to the specification of the showcase 100. That is, two or more components may be combined into a single component, or a single component may be divided into two or more components as needed. In addition, functions of respective blocks are merely given for explanation of the embodiment of the present invention and the scope of the present invention is not limited by concrete operations or devices related to the functions.

Figure 3:
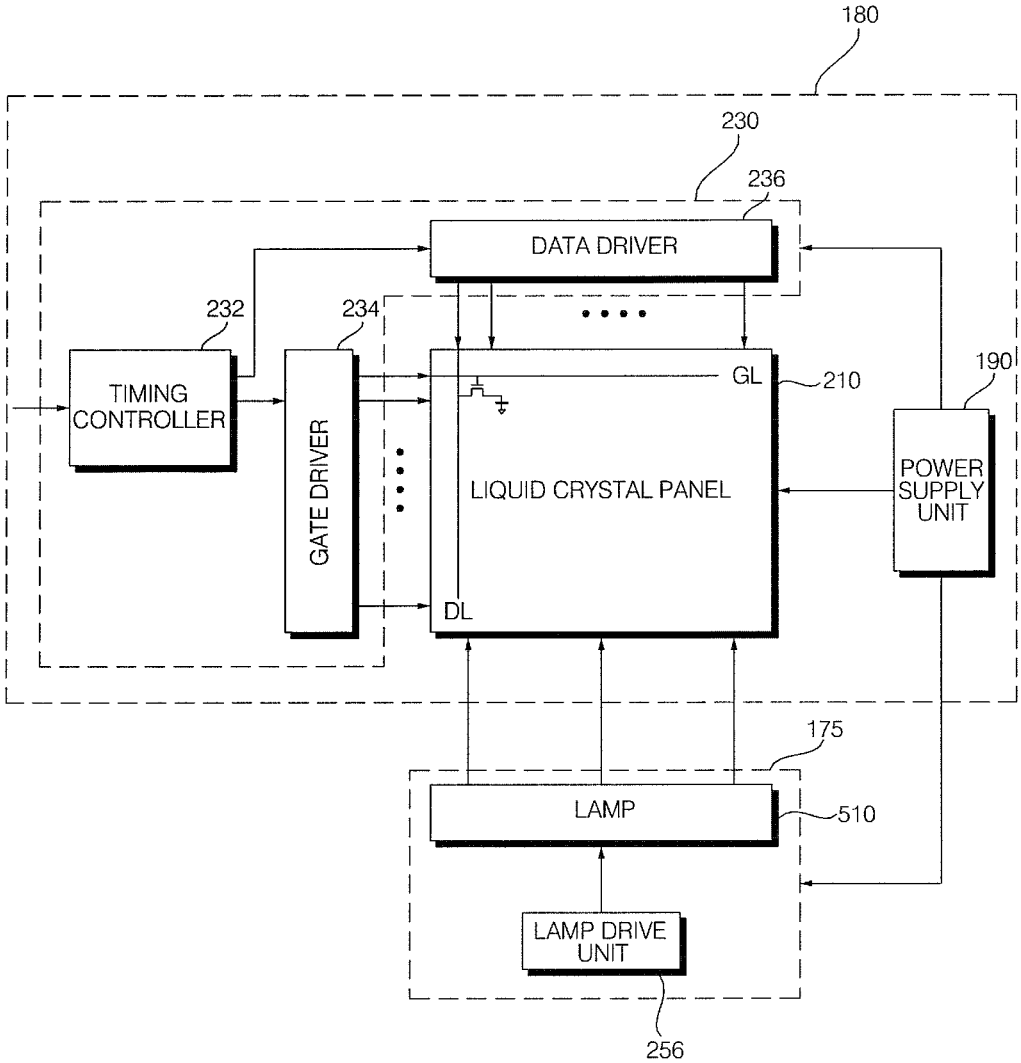
FIG. 3 is a view showing one example of an inner configuration of a display unit shown in FIG. 2.

FIG. 3 is a view showing one example of an inner configuration of the display unit shown in FIG. 2.

Referring to the drawing, the display unit 180 in the showcase 100 includes the liquid crystal display panel 210 and a drive circuit unit 230.

Referring to the drawing, the display unit 180 includes the liquid crystal panel 210 and the drive circuit unit 230.

Meanwhile, a conventional backlight unit is coupled to the liquid crystal panel 210 in the display unit 180 and supplies generated light to the liquid crystal panel 210.

However, according to the embodiment of the present invention, the backlight unit, i.e. the light source unit 175 is spaced apart from the liquid crystal panel 210. That is, as described above with reference to FIG. 1, the light source unit 175 may be provided as a separate unit that is obliquely installed in the upper region of the showcase 100.

In this way, the liquid crystal panel 210, which is a transparent display panel separated from the light source unit 210, displays a corresponding image upon receiving an image signal and, more particularly, displays a transparent image to allow a product in the showcase 100 to be visible.

To display an image, the liquid crystal panel 210 includes a first substrate on which a plurality of gate lines GL and data lines DL intersect one another to form a matrix and thin film transistors and pixel electrodes connected to the respective thin film transistors are arranged at intersections of the gate lines and the data lines, a second substrate having a common electrode, and a liquid crystal layer formed between the first substrate and the second substrate. Meanwhile, a color filter for color display may further be disposed on the second substrate.

The drive circuit unit 230 drives the liquid crystal panel 210 using a control signal and a data signal supplied from the controller 170 of FIG. 2. To this end, the drive circuit unit 230 may include a timing controller 232, a gate driver 234 and a data driver 236.

The timing controller 232 receives a control signal, R, G and B data signals, a vertical synchronization signal Vsync and the like from the controller 170. Thereby, the timing controller controls the gate driver 234 and the data driver 236 in response to the control signal, and rearranges the R, G and B data signals to provide the same to the data driver 236.

Meanwhile, through control of the gate driver 234, the data driver 236 and the timing controller 232, a scan signal and an image signal are supplied to the liquid crystal panel 210 through the gate lines GL and the data lines DL.

Although the drawing shows the drive circuit unit 230 as including the timing controller 232, the gate driver 234 and the data driver 236, alterations in terms of configuration are possible. For example, the gate driver 234 and the data driver 236 may be embedded in an upper portion and/or a lower portion of the front frame 90 of the showcase 100, and the timing controller 232 may be located at a left portion of the front frame 90 of the showcase 100. This will be described below with reference to FIG. 12.

The light source unit 175 supplies light into the showroom 70 of the showcase 100. In the embodiment of the present invention, to reduce shadowing of a product placed near the center of the showroom 70 due to light of the light source unit 175, the light source unit 175 is located between the front frame 90 and the upper frame 820. In particular, the light source unit is obliquely arranged between the front frame 90 and the upper frame 820. This will be described below with reference to FIG. 5.

Meanwhile, the light source unit 175 may include lamps 510 as a light source and a lamp drive unit 256 to turn the lamps 510 on or off.

When the plurality of lamps 510 is turned on, light emitted from the lamps 510 is directed to a product placed near the center of the showroom 70.

Meanwhile, the liquid crystal panel 210 may display an image based on an input image signal using light directed into the showroom 70.

Meanwhile, the plurality of lamps 510 may include Light Emitting Diodes (LEDs).

The power supply unit 190 may supply a common electrode voltage Vcom to the liquid crystal panel 210 and may supply a gamma voltage to the data driver 236. In addition, the power supply unit may supply drive power, required to drive the lamps 510, to the light source unit 175.

Figure 4:
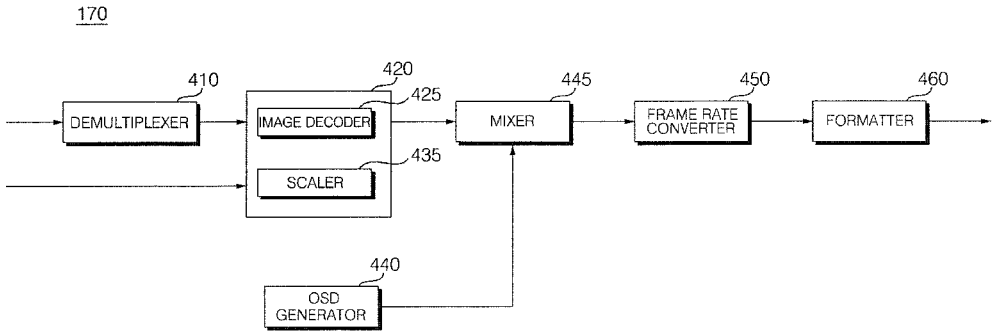
FIG. 4 is a block diagram showing an inner configuration of a controller shown in FIG. 2.

FIG. 4 is a block diagram showing an inner configuration of the controller shown in FIG. 2.

Explaining the controller with reference to the drawing, the controller 170 according to one embodiment of the present invention may include a demultiplexer 410, an image processor 420, an OSD generator 440, a mixer 445, a frame rate converter 450, and a formatter 460. In addition, the controller may further include a voice processor (not shown) and a data processor (not shown).

The demultiplxer 410 may demultiplex an input stream. For example, when MPEG-2 TS is input, the demultiplexer may separate the same into image, voice and data signals via demultiplexing.

The image processor 420 may process a demultiplexed image signal. To this end, the image processor 420 may include an image decoder 425 and a scaler 435.

The image decoder 425 may decode the demultiplexed image signal and the scaler 435 may implement scaling to allow the display unit 180 to output resolution of the decoded image signal. The image decoder 425 may have one of various standards.

The OSD generator 440 generates an OSD signal in response to user input or by itself. For example, the OSD generator may generate a signal to display various graphic or text information on a screen of the display unit 180 based on a user input signal. The generated OSD signal may include various data including a user interface screen, various menu screens, widgets, icons and the like that may be displayed on the liquid crystal panel 210 of the showcase 100.

The mixer 445 may mix the OSD signal generated by the OSD generator 440 with the decoded image signal processed by the image processor 420. The mixed image signal is transmitted to the frame rate converter 450.

The frame rate converter (FRC) 450 may convert the frame rate of an input image. Meanwhile, the frame rate converter 450 may directly output the image signal without conversion of the frame rate.

The formatter 460 receives the mixed signals, i.e. the OSD signal and the decoded image signal from the mixer 445, and outputs the signals after changing the signals into a format suitable for the display unit 180. For example, the formatter may output R, G and B data signals via Low Voltage Differential Signaling (LVDS) or mini-LVDS.

Meanwhile, the formatter 460 may change the format of a 3D image signal, or may convert a 2D image signal into a 3D image signal, for display of a 3D image.

Meanwhile, the voice processor (not shown) in the controller 170 may implement voice processing of a demultiplexed audio signal. To this end, the voice processor (not shown) may include various decoders.

In addition, the voice processor (not shown) in the controller 170 may process base, treble, and sound-level adjustment, for example.

The data processor (not shown) in the controller 170 may implement data processing of a demultiplexed data signal.

Figure 5:
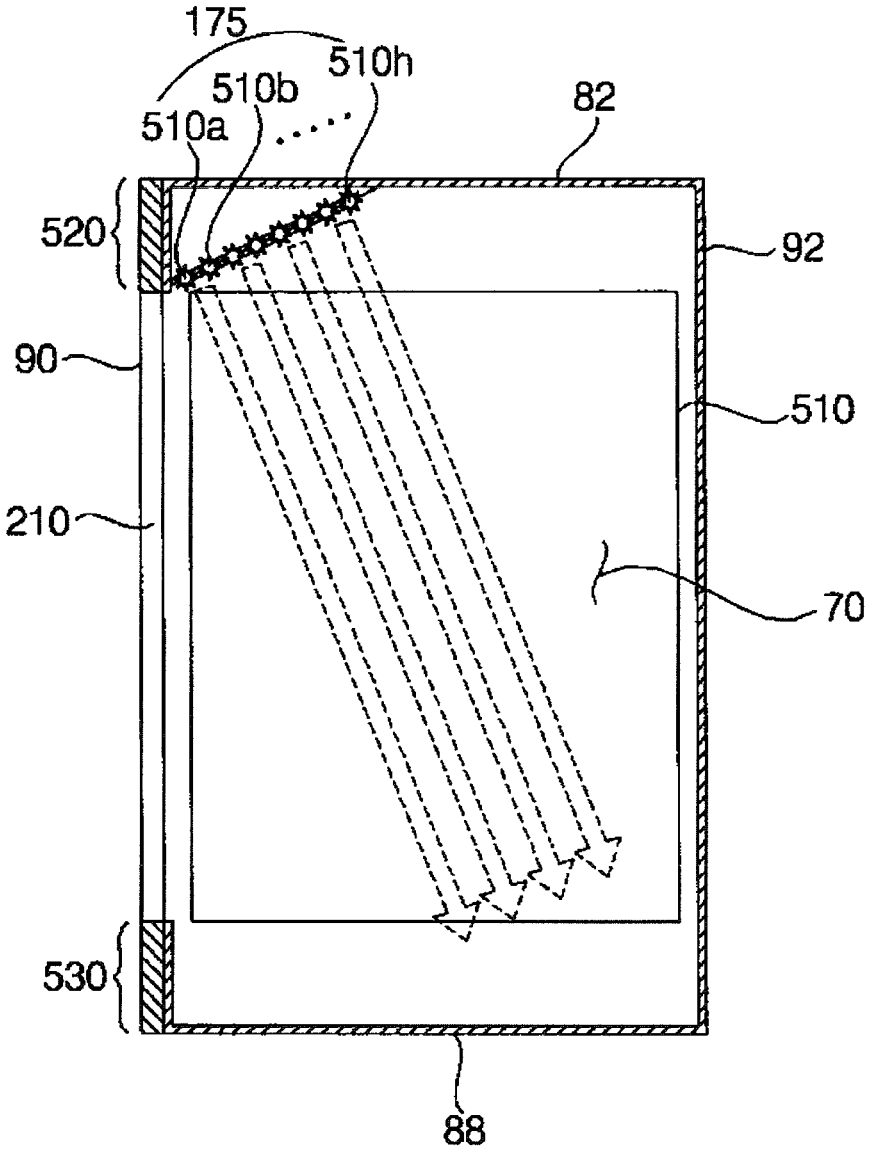
FIG. 5 is a sectional view taken along line A-A' of the showcase shown in FIG. 1 according to one example.

Meanwhile, the block diagram of FIG. 5 shows the controller 170 according to one embodiment of the present invention. The respective components of the block diagram may be integrated, added, or omitted according to the actually realizable specification of the controller 170.

In particular, the frame rate converter 450 and the formatter 460 may be not included in the controller 170 and be separately provided.

FIG. 5 is a sectional view taken along line A-A' of the showcase shown in FIG. 1 according to one example.

Referring to the drawing, the showcase 100 cut along A-A' of FIG. 1 is shown in FIG. 5 in sectional view.

In the embodiment of the present invention, the lamps 510*a*, 510*b*, . . . , 510*h* of the light source unit 175 may be obliquely arranged in the upper region of the showcase 100.

More specifically, assuming that the front frame 910 is divided into the transparent liquid crystal panel 210, an opaque upper portion 520 and an opaque lower portion 530, the lamps 510*a*, 510*b*, . . . , 510*h* of the light source unit 175 may be arranged in a region corresponding to the upper portion 520 of the front frame 910. Thereby, the light source unit 175 is invisible from the front of the showcase 100.

Meanwhile, to minimize shadowing of a product placed in the showroom 70 of the showcase 100 by uniformly transmitting light from the light source unit 175 to the product, the lamps 510*a*, 510*b*, . . . , 510*h* of the light source unit 175 are preferably obliquely arranged.

More specifically, preferably, the lamps 510*a*, 510*b*, . . . , 510*h* of the light source unit 175 are arranged between the upper portion 520 of the front frame 910 and the upper frame 820 and are obliquely arranged in a direction from the upper portion 520 of the front frame 910 to the upper frame 820. That is, preferably, a second lamp 510*b* is located higher than a first lamp 510*a* and an eighth lamp 510*h* is located higher than the second lamp 510*b*.

In this way, the light source unit 175 is invisible from the front of the showcase 100 and light from the light source unit 175 is uniformly transmitted to the product placed in the showroom 70 to minimize shadowing of the product.

Meanwhile, the lamps 510*a*, 510*b*, . . . , 510*h* of the light source unit 175 may be attached to a fixing member (not shown). In this case, the fixing member may be obliquely installed between the front frame 90 and the upper frame 82.

Meanwhile, although not shown in the drawing, a display stand (not shown) may be placed in the showroom 70 and a product may be placed on the display stand.

Figure 6:
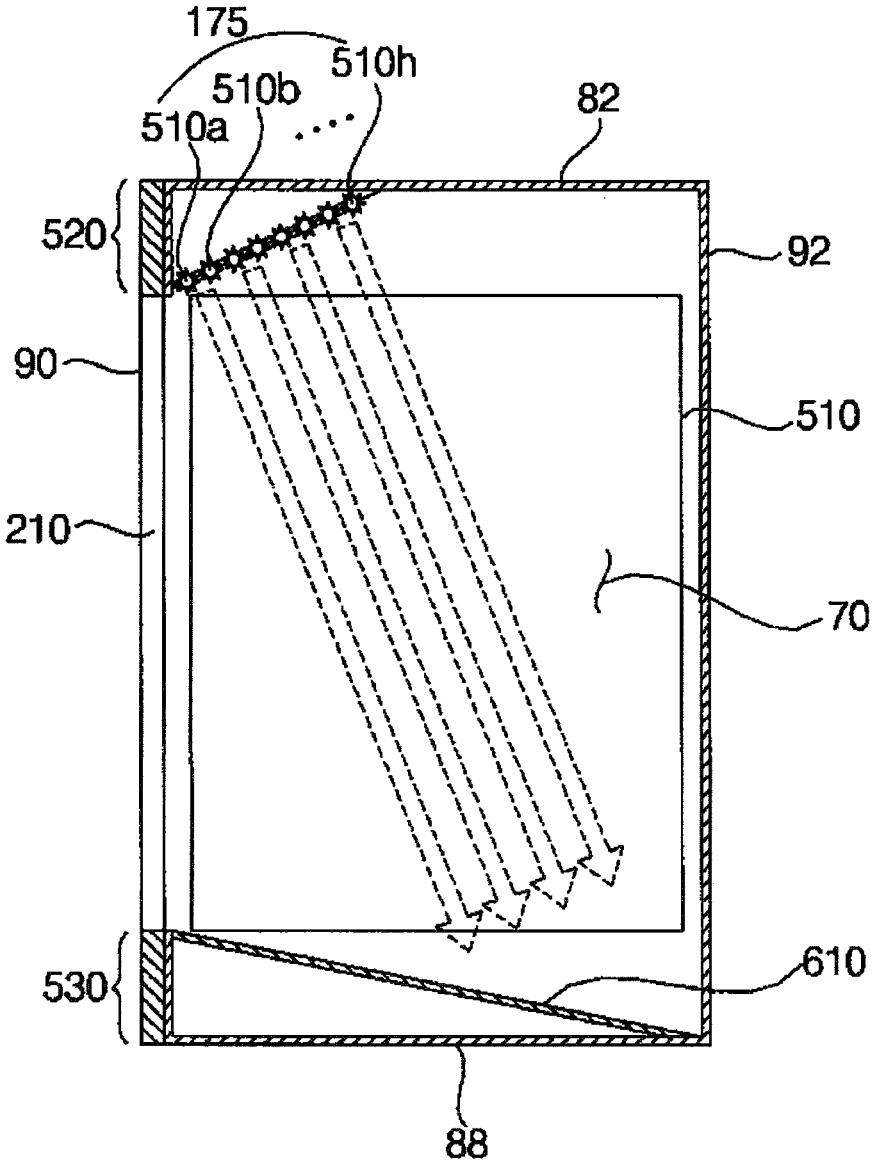
FIG. 6 is a sectional view taken along line A-A' of the showcase shown in FIG. 1 according to another example.

FIG. 6 is a sectional view taken along line A-A' of the showcase shown in FIG. 1 according to another example.

Referring to the drawing, the sectional view of FIG. 6 is similar to the sectional view of FIG. 5. That is, in terms of the lamps 510*a*, 510*b*, . . . , 510*h* of the light source unit 175 being obliquely arranged in the upper region of the showcase 100, FIG. 6 is similar to FIG. 5.

Meanwhile, differently from FIG. 5, there is a difference that the height of a bottom surface 610 of the showroom 70 is reduced with increasing distance from the front frame 90 or decreasing distance to the rear frame 92.

When the bottom surface 610 of the showroom 70 on the lower frame 88 has a downhill structure as shown in the drawing, a user who is located in front of the showcase 100 may perceive the showroom 70 as having a three-dimensional space. Thus, the user may stereoscopically view the product in the showroom 70.

Meanwhile, the lamps 510*a*, 510*b*, . . . , 510*h* of the light source unit 175 may be attached to a fixing member (not shown). In this case, the fixing member may be obliquely installed between the front frame 90 and the upper frame 82.

Meanwhile, although not shown in the drawing, a display stand (not shown) may be placed in the showroom 70 and the product may be placed on the display stand.

Figure 7:
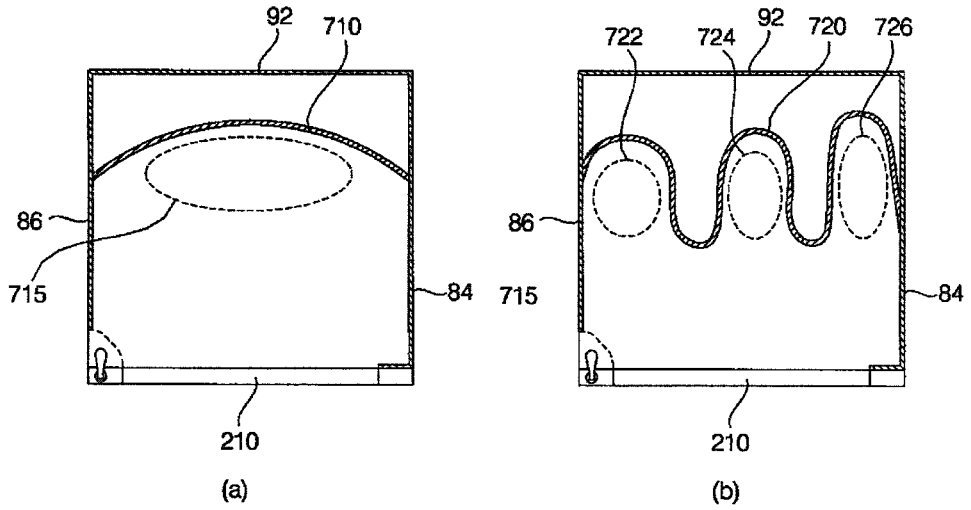
FIG. 7 is a sectional view taken along line B-B' of the showcase shown in FIG. 1 according to one example.

FIG. 7 is a sectional view taken along line B-B' of the showcase shown in FIG. 1 according to one example.

Referring to the drawing, when cutting the showcase 100 along line B-B' of FIG. 1, the sectional view of FIG. 7(*a*) or FIG. 7(*b*) may be acquired.

First, as exemplarily shown in FIG. 7(*a*), when a rear face 710 of the showroom 70 facing the rear frame 92 is convexly curved in an oval form toward the rear frame 92, there occurs no edge at seams of inner wall surfaces of the showcase, and thus likelihood of shadowing at a corresponding edge region may be reduced.

That is, as compared to the showroom 70 providing a hexahedral space, it is possible to improve uniformity of light at seams between wall surfaces and apex regions, and consequently to reduce likelihood of shadowing at these regions.

In this way, when a product is placed in an exhibition space 715 of FIG. 7(*a*), the product having reduced shadows is visible.

Next, although similar to FIG. 7(*a*), FIG. 7(*b*) differs from FIG. 7(*a*) in terms of the showroom 70 having a plurality of oval rear face portions 720 facing the rear frame 92.

The drawing shows that three oval rear face portions 720 are formed close to the rear frame 92.

This configuration may be adopted when a plurality of products is individually arranged in the showroom 70.

That is, a first product, a second product and a third produce may be arranged respectively in a first exhibition space 722, a second exhibition space 724 and a third exhibition space 726.

Thereby, there occurs no edge at seams of inner wall surfaces of the showcase 100, which may reduce or prevent shadowing at the corresponding edge region. In addition, the products arranged in the respective exhibition spaces 722, 724 and 726 may be distinguished from other products.

Figure 8:
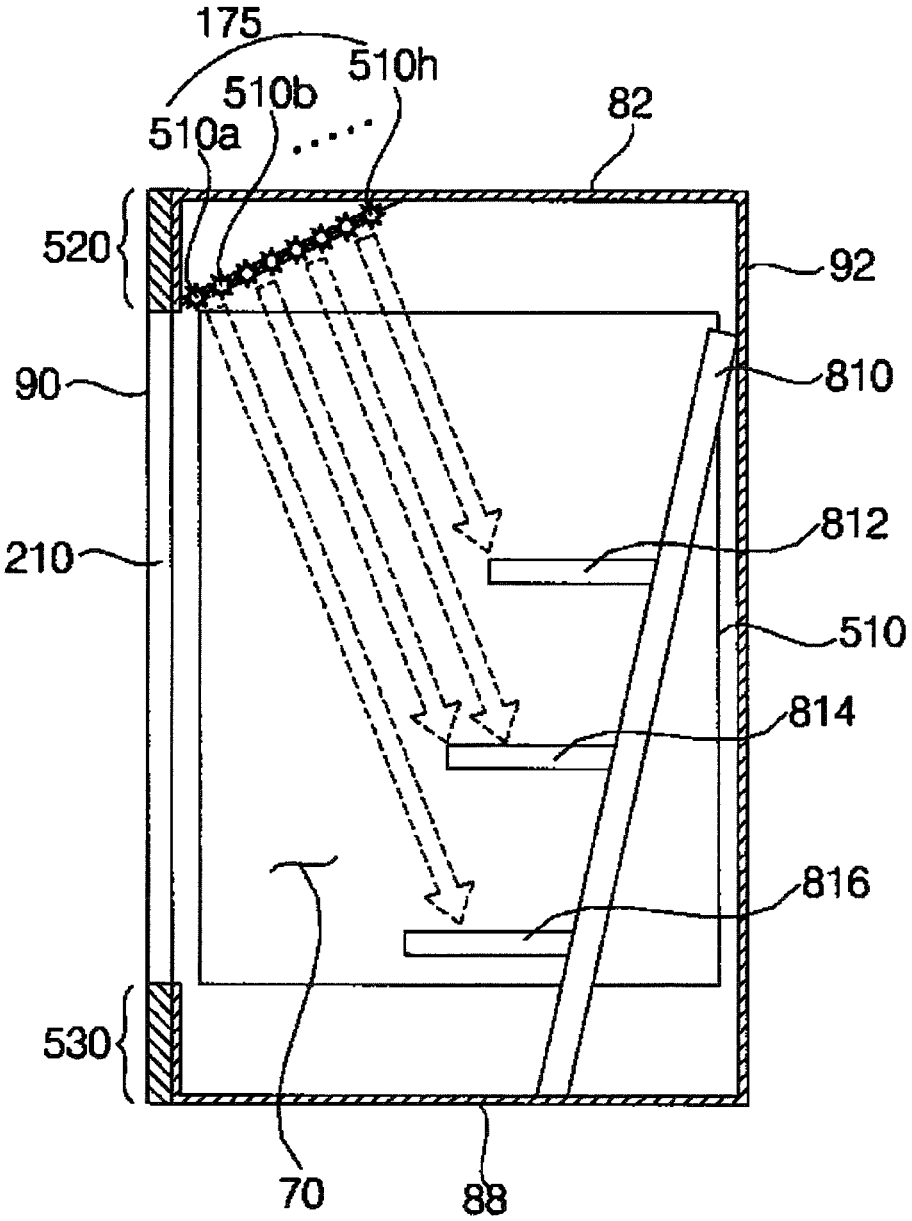
FIG. 8 is a sectional view taken along line A-A' of the showcase shown in FIG. 1 according to a further example.

FIG. 8 is a sectional view taken along line A-A' of the showcase shown in FIG. 1 according to a further example.

Referring to the drawing, the sectional view of FIG. 8 is similar to the sectional view of FIG. 5. That is, FIG. 8 is similar to FIG. 5 in terms of the lamps 510*a*, 510*b*, . . . , 510*h* of the light source unit 175 being obliquely arranged in the upper region of the showcase 100.

Meanwhile, differently from FIG. 5, a multi-stage display stand 810 is placed in the showroom 70.

The display stand 810 is preferably tilted from the rear frame 92 to the lower frame 88.

When the lamps 510*a*, 510*b*, . . . , 510*h* of the light source unit 175 are obliquely arranged between the upper portion 520 of the front frame 910 and the upper frame 820, to allow light emitted from the lamps 510*a*, 510*b*, . . . , 510*h* of the light source unit 175 to uniformly reach products in upper and lower regions of the showroom 70, in the embodiment of the present invention, the display stand 810 is tilted from the rear frame 92 to the lower frame 88.

With this configuration, when using the multi-stage display stand 810, light may be uniformly emitted to products placed at respective stages.

Meanwhile, although the drawing illustrates the display stand having three shelves 812, 814 and 816, various alterations are possible. For example, a shelf located lower than others may have a longer length. More specifically, the length of a second shelf 814 may be longer than the length of a first shelf 812 and the length of a third shelf 816 may be longer than the length of the second shelf 814. Thereby, light may reach a product on a lower shelf without being blocked by an upper shelf or a product on the upper shelf.

Meanwhile, all reflectors in the showroom 70 of the showcase 100 are preferably formed of white or transparent materials in consideration of reflection of light. More specifically, inner surfaces of the rear frame 92 and the lower frame 88 inside the showroom 70 are preferably formed of white materials for reflection. In addition, the display stand 810 and the shelves 821, 814 and 816 are preferably formed of white or transparent materials.

Figure 9:
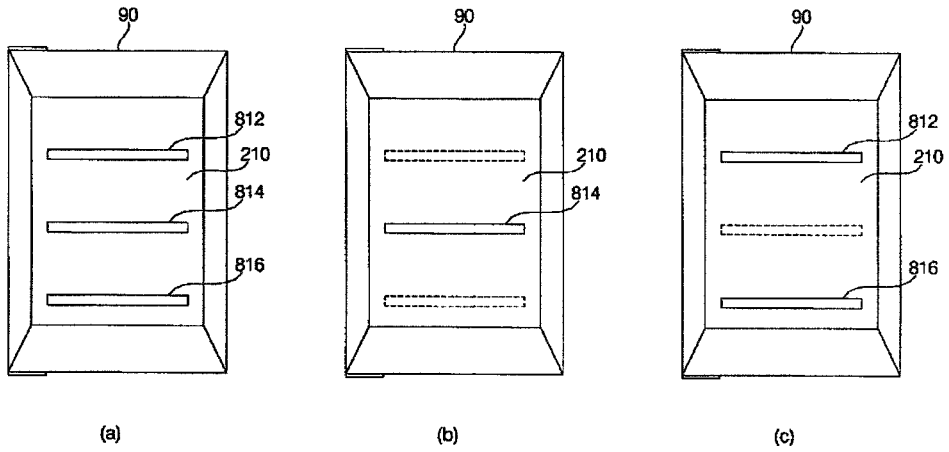
FIG. 9 is a view explaining various examples of the arrangement of shelves shown in FIG. 8.

FIG. 9 is a view explaining various examples of the arrangement of shelves shown in FIG. 8.

Referring to the drawing, FIGS. 9(*a*) to 9(*c*) are front views of the showcase 100 and show one example of the transparent liquid crystal panel 210 and the display stand 810 placed in the showroom 70.

First, FIG. 9(*a*) shows that all three shelves 812, 814, and 816 included in the three-stage display stand of FIG. 8 are coupled to the display stand.

Next, FIG. 9(*b*) shows that the first shelf 812 and the third shelf 816 among the three shelves 812 814, and 816 are removed and only the second shelf 814 is coupled to the display stand.

Next, FIG. 9(*c*) shows that the second shelf 814 among the three shelves 812, 814 and 816 is removed and the first shelf 812 and the third shelf 816 are coupled to the display stand.

Accordingly, through attachment or detachment of the multiple shelves to or from the display stand 810 according to the embodiment of the present invention, the arrangement of products in the showroom of the showcase may be simply changed. More specifically, assuming that the front frame takes the form of a door, a desired shelf may be attached to or detached from the display stand through the open front door.

Figure 10:
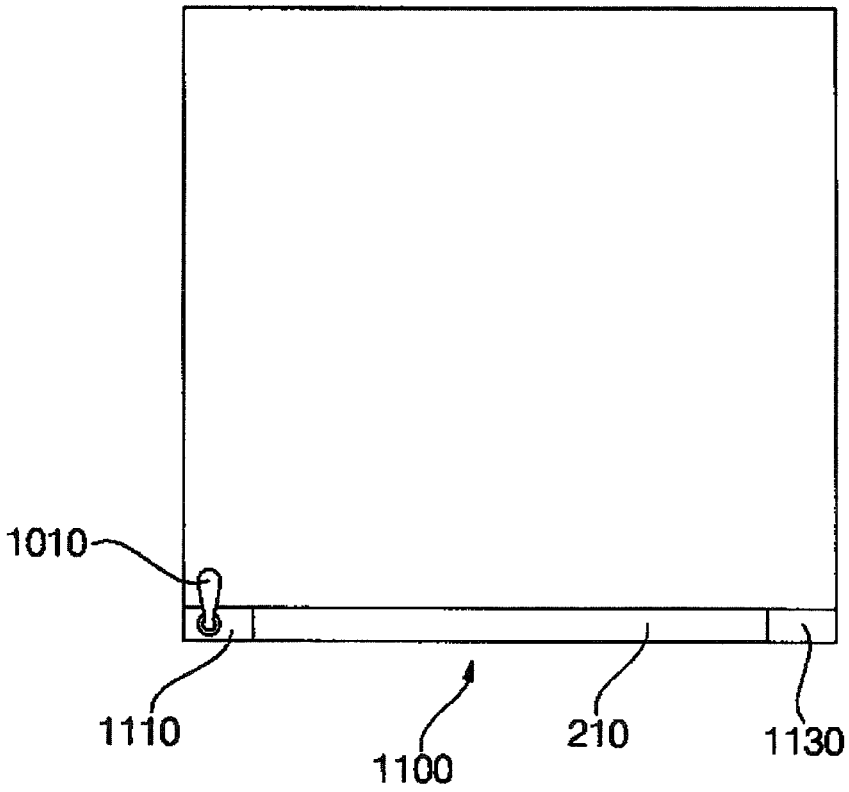
FIGS. 10 to 12 are reference views explaining a door structure of the showcase shown in FIG. 1.
Figure 11:
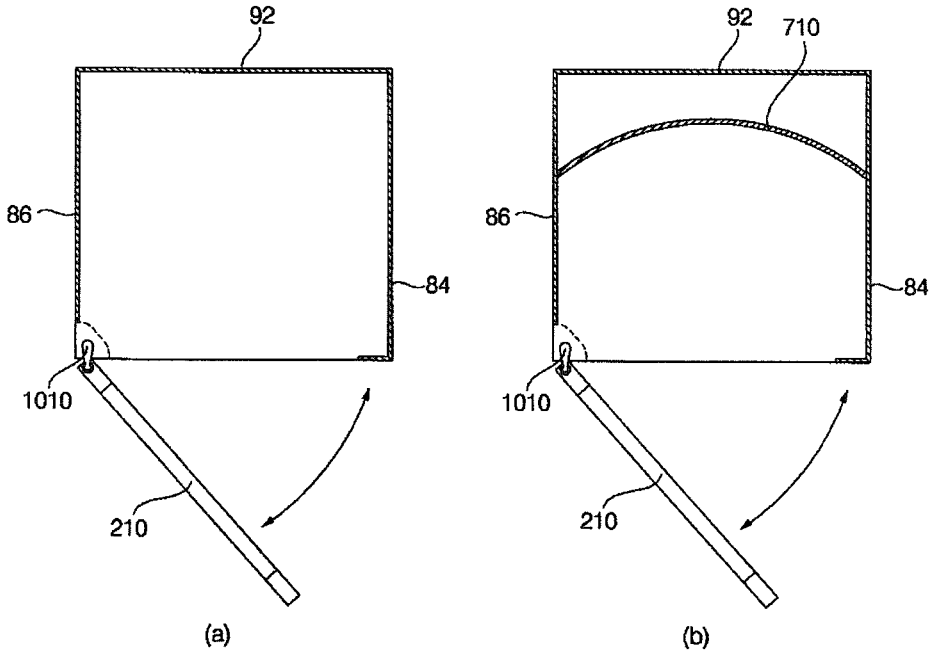
Figure 12:
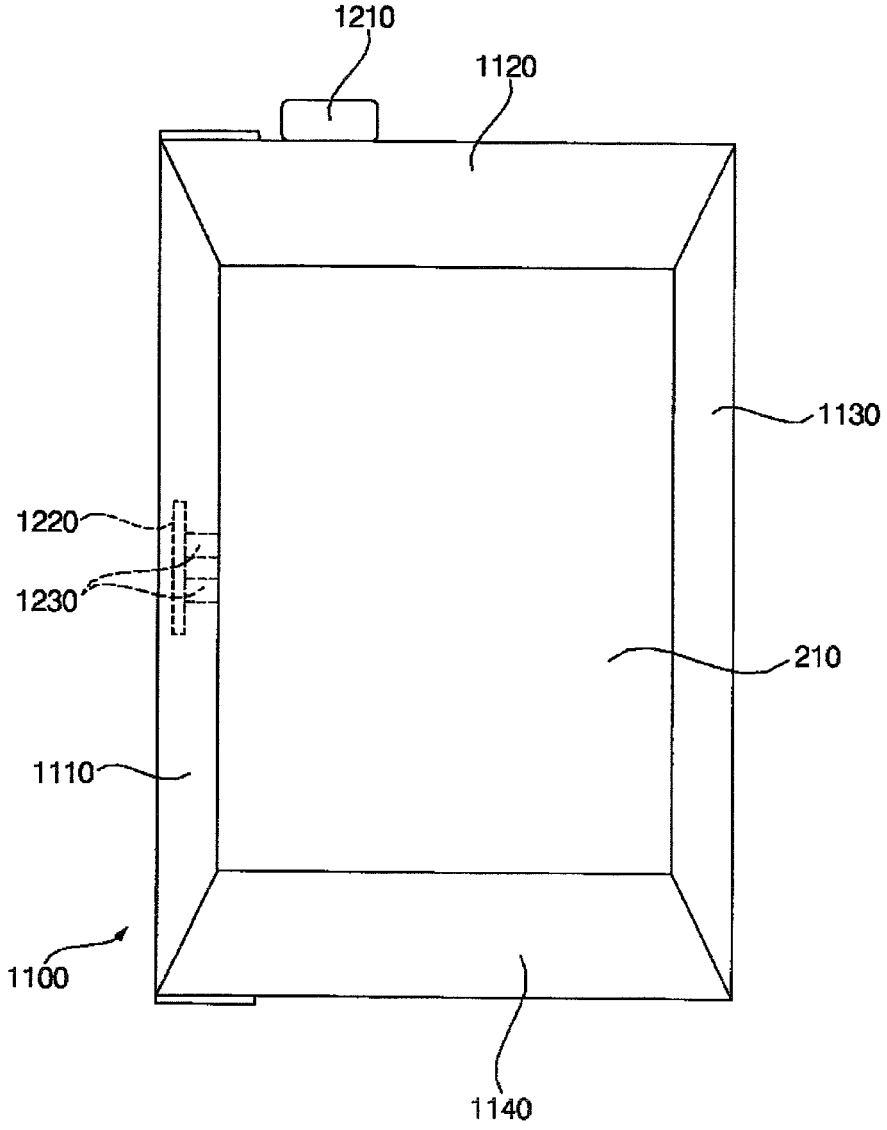

FIGS. 10 to 12 are reference views explaining a door structure of the showcase shown in FIG. 1.

Referring to the drawings, the front frame 90 of the showcase 100 may take the form of a door that can be open or closed.

Referring to the drawings, a front door 1100 corresponding to the front frame 90, as exemplarily shown in FIG. 12, may include first to fourth doorframes 1110, 1120, 1130 and 1140 surrounding the liquid crystal panel 210. The liquid crystal panel 210 may be secured in the front door 1100 by the first to fourth doorframes 1110, 1120, 1130 and 1140.

FIG. 10 shows the showcase of FIG. 1 viewed from the top in sectional view. As shown in the drawing, the front door 1100 may be attached to the showcase 100 via a hinge 1010. More specifically, the door may be attached to the upper frame 82 of the showcase 100.

Meanwhile, FIG. 11(*a*) shows opening/closing of the front door 1100 of FIG. 10. Meanwhile, FIG. 11(*b*) shows opening/closing of the front door 1100 when the rear face 710 of the showroom 70 has an oval shape as exemplarily shown in FIG. 7(*a*).

In this way, the front door 1100 configured to be opened and closed may allow the user to simply change positions of products in the showroom 70 or positions of the shelves 812, 814, and 816 of the display stand 810.

Meanwhile, to prevent damage to the liquid crystal panel 210 when opening or closing the front door 1100, the front door 1100 may further include a damper (not shown) attached thereto, in addition to the first to fourth doorframes 1110, 1120, 1130 and 1140 as described above.

Meanwhile, upon opening of the front door 1100, the lamps of the light source unit 175 may be turned off. When opening the front door 1100 and changing positions of the shelves 812, 814 and 816 of the display stand 810 or positions of products in the showroom 70, turning off the lamps of the light source unit 175 may prevent glare and assist the user in easily displaying products.

To this end, a door opening/closing sensing unit (not shown) may be additionally provided and the lamp drive unit 256 may turn off the lamps based on sensed results.

Meanwhile, referring to FIG. 12, the first doorframe 1110 of the front door 1100 may be provided with a timing controller board 1220. To supply a drive signal required to drive the liquid crystal panel 210, the timing controller board 1220 may include a timing controller 232.

Meanwhile, the timing controller board 1220 and the liquid crystal panel 210 may be connected to each other using a flexible cable 1230. For example, the flexible cable 1230 may be a Flexible Flat Cable (FFC).

Meanwhile, the timing controller board 1220 may further include the data driver 236 and the gate driver 234 of FIG. 3, in addition to the timing controller 232. In this case, the flexible cable 1230 supplies a data drive signal and a gate drive signal to the liquid crystal panel.

Meanwhile, in another example, the timing controller board 1220 may include the timing controller 232 and the gate driver 234, and the data driver 236 may be omitted. In this case, the data driver 236 may be installed to the second doorframe 1120.

Meanwhile, since the timing controller board 1220 is installed to the first doorframe 1110 among the doorframes, the first doorframe 1110 preferably has a greater size (e.g., width and thickness) than that of the third doorframe 1130 facing the first doorframe. That is, the first doorframe 1110 and the third doorframe 1130 may be asymmetrical to each other.

Meanwhile, FIG. 12 shows that a signal processing unit 1210 is placed on the top of the showcase 100, i.e. on the upper frame 82. The signal processing unit 1210 may be called an AD board. A description related to the signal processing unit 1210 will follow with reference to FIG. 14.

Meanwhile, for connection of the signal processing unit 1210 and the timing controller board 1220, a connection cable is embedded in a hole of the first doorframe 1110 to electrically connect the signal processing unit 1210 and the timing controller board 1220 to each other.

Meanwhile, differently from the drawing, both the signal processing unit 1210 and the timing controller board 1220 may be installed in the first doorframe 1110. To this end, the first doorframe 1110 may have a sufficient size for installation of the signal processing unit 1210 and the timing controller board 1220.

Figure 13:
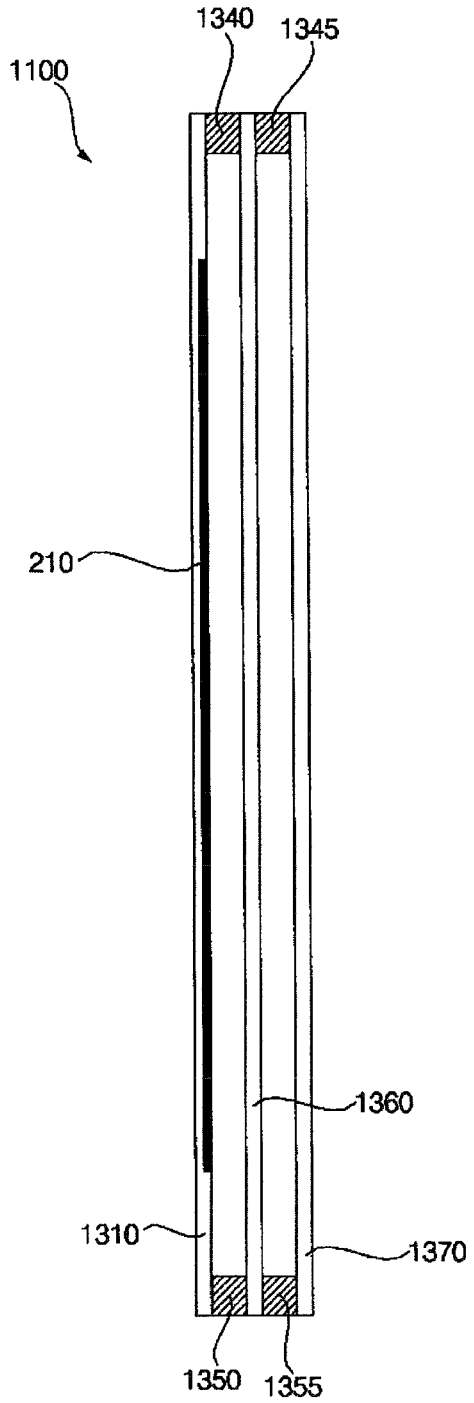
FIG. 13 is a reference view explaining a door structure of the showcase shown in FIG. 11.

FIG. 13 is a reference view explaining a door structure of the showcase shown in FIG. 11.

Referring to the drawing, the front door 1100 may include the liquid crystal panel 210, a first door glass 1310 to which the liquid crystal panel 210 is attached, a second door glass 1360 spaced apart from the first door glass 1310, and a third door glass 1370 spaced apart from the second glass. The third door glass 1370 may be closest to the interior of the showroom.

When the showcase 100 according to the embodiment of the present invention is applied to a refrigerator, the front door 1100 may be a refrigerator door. In the case of the refrigerator door to which the transparent liquid crystal panel 210 is attached, heat radiation is preferable to prevent cold air in the refrigerator from having a negative effect on operation of a liquid crystal layer of the liquid crystal panel.

To this end, as exemplarily shown in FIG. 13, the front door 1100 may consist of a plurality of glasses. Meanwhile the first door glass 1310 and the second door glass 1360 may be adhered to each other by upper and lower adhesive members 1340 and 1350, and the second glass 1320 and the third door glass 1370 may be adhered to each other via upper and lower adhesive members 1345 and 1355. In this case, the adhesive members 1340, 1345, 1350 and 1355 may be a transparent adhesive or a double-sided tape.

Meanwhile, differently from the drawing, the front door 1100 may include the liquid crystal panel 210, the first glass 1310 to which the liquid crystal panel 210 is attached, and the second glass 1360 spaced apart from the first glass 1310. In this case, the second glass 1360 may be closest to the interior of the showroom.

Figure 14:
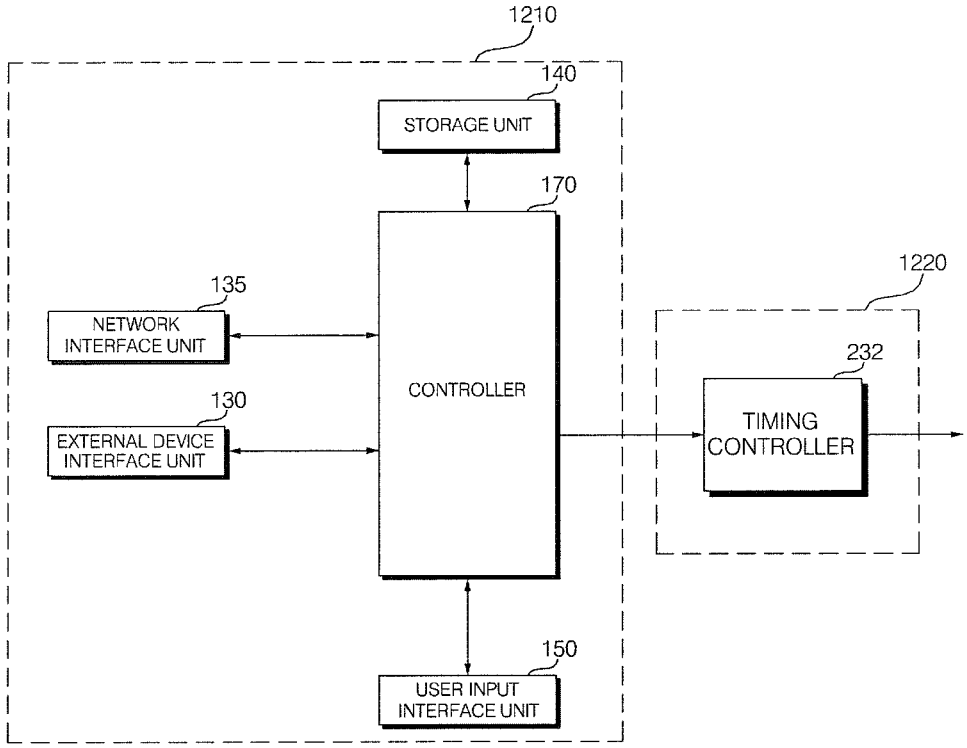
FIG. 14 is a block diagram showing an inner configuration of a signal processing unit included in the showcase of FIG. 1.

FIG. 14 is a block diagram showing an inner configuration of a signal processing unit included in the showcase of FIG. 1.

Referring to the drawing, FIG. 14 shows the signal processing unit 1210. As mentioned above in the description of FIG. 12, the signal processing unit 1210 may be separated from the timing controller board 1220.

The signal processing unit 1210 may process a video signal for display of an image on the liquid crystal panel 210.

Accordingly, the signal processing unit 1210 may include the external device interface unit 130, the network interface unit 135, the storage unit 140, the user input interface unit 150, and the controller 170.

Operation of the respective units 130, 135, 140, 150 and 170 in the signal processing unit 1210 has been described above with reference to FIG. 2 and thus, a description thereof will be omitted hereinafter.

Meanwhile, a control signal, R, G and B data signals, a vertical synchronization signal Vsync and the like processed by the signal processing unit 1210 are LVDS signals and may be transmitted to the timing controller board 1220.

The timing controller 232 in the timing controller board 1220 may process the control signal, R, G and B data signals, vertical synchronization signal Vsync and the like to generate and output a data drive signal and a gate drive signal.

Meanwhile, as described above, the timing controller board 1220 may further include the gate driver 234 and the data driver 236, in addition to the timing controller 232. In this case, the timing controller board 1220 may correspond to the drive circuit unit 230 as described above with reference to FIG. 3.

Figure 15:
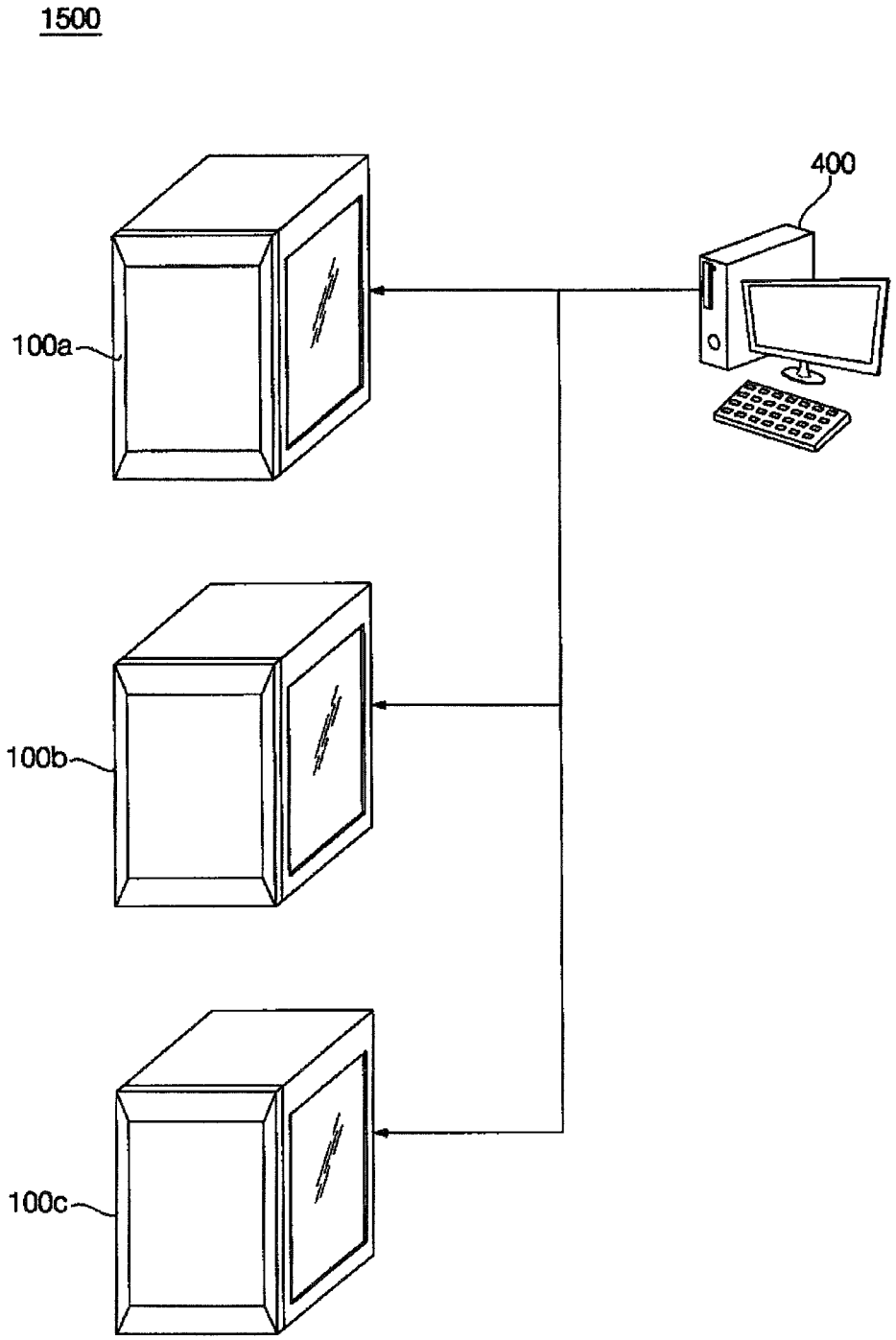
FIG. 15 is a view schematically showing a configuration of a showcase system according to another embodiment of the present invention.
Figure 16:
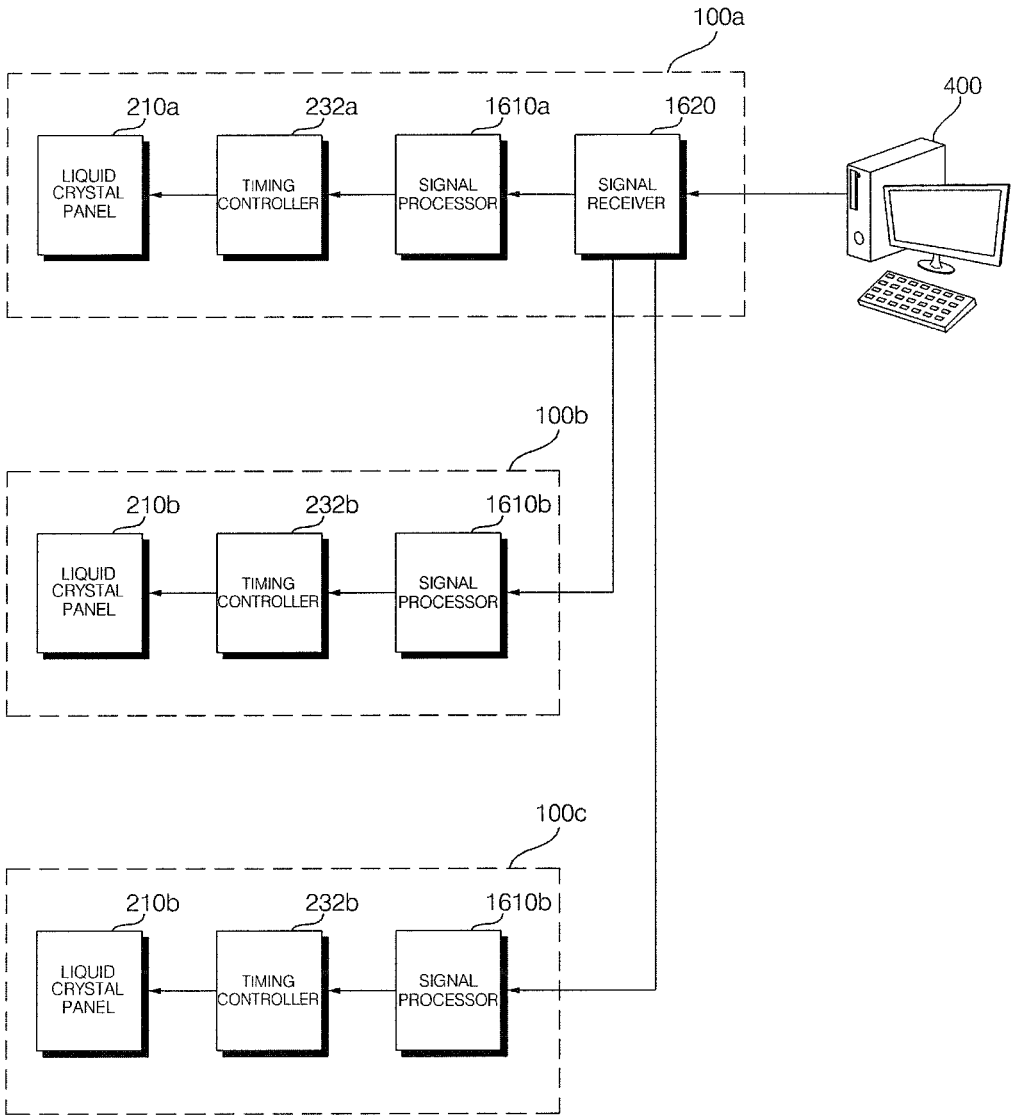
FIG. 16 is a block diagram schematically showing an inner configuration of the showcase system shown in FIG. 15.

FIG. 15 is a view schematically showing a configuration of a showcase system according to another embodiment of the present invention, and FIG. 16 is a block diagram schematically showing an inner configuration of the showcase system shown in FIG. 15.

Referring to the drawing, the showcase system of FIG. 15 may include a plurality of showcases 100*a*, 100*b* and 100*c* and the signal processing device 400.

The showcases 100*a*, 100*b* and 100*c* may be arranged next to one another. As such, the signal processing device 400 may provide the respective showcases 100*a*, 100*b* and 110*c* arranged next to one another with related images.

FIG. 15 shows that the signal processing device 400 provides the respective showcases 100*a*, 100*b* and 100*c* with corresponding image signals, for example. That is, the same image may be provided to all of the showcases 100*a*, 100*b* and 100*c*, or different images may be provided to the respective showcases 100*a*, 100*b* and 100*c*.

Meanwhile, as exemplarily shown in FIG. 16, the signal processing device 400 may provide the first showcase 100*a* with images that will be displayed respectively on the showcases 100*a*, 100*b* and 100*c*. In this case, the first showcase 100*a* may distribute received first to third images to the second showcase 100*b* and the third showcase 100*c*.

To this end, as exemplarily shown in FIG. 16, the first showcase 100*a* may further include a signal receiver 1620, differently from the other showcases 100*b* and 100*c*. The signal receiver 1620 serves to receive images from the signal processing device 400 and to distribute the images to the respective showcases.

Meanwhile, the respective showcases 100*a*, 100*b* and 100*c* may include signal processors 1610*a*, 1610*b* and 1610*c* for signal processing of input images, timing controllers 232*a*, 232*b* and 232*c* for conversion of a processed video signal into a gate drive signal and a data drive signal, and transparent liquid crystal panels 210*a*, 210*b* and 210*c* for display an image in response to a corresponding drive signal.

A showcase including a transparent display panel according to the present invention should not be limited to configurations and methods of the embodiments as described above, and some or all of the embodiments may be selectively combined with one another to enable various alterations thereof.

Although the preferred embodiments of the present invention have been illustrated and described, those skilled in the art will appreciate that the present invention should not be limited to the above specific embodiments and various modifications thereof are possible without departing from the scope and spirit of the invention as disclosed in the accompanying claims and these modifications should not be understood independently of the technical idea of the present invention.

The invention claimed is:

1. A showcase comprising:

a plurality of frames including a front frame and an upper frame defining a showroom;

a transparent display panel placed at the front frame, the transparent display panel displaying an image; and a light source unit configured to emit light into the showroom, wherein the light source unit is located between an opaque upper portion of the front frame surrounding the transparent display panel and the upper frame, and wherein the light source unit includes a plurality of lamps at each corner of the showcase and is obliquely arranged in a direction from the front frame to the upper frame, and positions of the plurality of lamps are increased in height with an increasing distance from the front frame to the upper frame.

2. The showcase according to claim 1, wherein the height of a bottom surface of the showroom is reduced with increasing distance from the front frame or decreasing distance to a rear frame among the frames.

3. The showcase according to claim 1, wherein a rear face of the showroom has at least one oval structure convexly protruding toward a rear frame among the frames.

4. The showcase according to claim 1, further comprising a display stand tilted in the showroom in a direction from a rear frame to a lower frame among the frames.

5. The showcase according to claim 4, further comprising multiple shelves detachably attached to the display stand.

6. The showcase according to claim 5, wherein the multiple shelves are increased in length in a downward direction of the showroom.

7. The showcase according to claim 1, wherein the front frame takes the form of a front door configured to be opened and closed.

8. The showcase according to claim 7, wherein the front door includes the transparent display panel and doorframes surrounding the transparent display panel.

9. The showcase according to claim 8, further comprising:

a timing controller installed in a first doorframe among the doorframes, the timing controller supplying a drive signal to the transparent display panel; and a cable transmitting the drive signal from the timing controller to the display panel.

10. The showcase according to claim 9, wherein the first doorframe located at one side of the transparent display panel has a greater size than that of a second doorframe, the second door frame being located opposite to the first door frame about the panel.

11. The showcase according to claim 7, wherein the light source unit is turned off when the front door is open or closed.

12. The showcase according to claim 7, wherein the front door includes:

a first door glass attached to the transparent display panel;

a second door glass spaced apart from the first door glass; and an adhesive member attaching the first door glass and the second door glass to each other.

13. The showcase according to claim 1, further comprising a signal processing unit installed in the upper frame among the frames, the signal processing unit processing an input image signal.

14. The showcase according to claim 13, wherein the signal processing unit includes:

an external device interface unit configured to receive a video signal from an external device; and a controller configured to process the received video signal and to output the processed video signal.

15. The showcase according to claim 1, wherein the transparent display panel is a liquid crystal panel including a first substrate provided with a pixel electrode, a second substrate provided with a common electrode, and a liquid crystal layer formed between the first substrate and the second substrate.

16. A showcase system comprising:

a signal processing device configured to output a video signal; and a showcase including a plurality of frames including a front frame and an upper frame defining a showroom, a transparent display panel placed at the front frame, the transparent display panel displaying an image corresponding to the video signal, and a light source unit configured to emit light into the showroom, wherein the light source unit includes a plurality of lamps at each corner of the showcase and is obliquely arranged in a direction from the front frame to the upper frame among the frames, and positions of the plurality of lamps are increased in height with an increasing distance from the front frame to the upper frame.

17. The showcase system according to claim 16, wherein the showcase includes a plurality of showcases, and wherein a first showcase among the plurality of showcases further includes a signal receiver configured to receive the video signal from the signal processing device and to distribute the received video signal to each showcase.

* * * * *